United States Patent [19]

Mehl et al.

[11] Patent Number: 4,636,223

[45] Date of Patent: Jan. 13, 1987

[54] HEAT TRANSFER PRINTING OF NATURAL SILK SUBSTRATES

[75] Inventors: Wolfgang Mehl, Geneva; Albert Amon, Lausanne, both of Switzerland

[73] Assignee: Sicpa Holding S.A., Switzerland

[21] Appl. No.: 719,498

[22] Filed: Apr. 4, 1985

[30] Foreign Application Priority Data

Apr. 12, 1984 [EP] European Pat. Off. ..... 84810182.0

[51] Int. Cl.[4] ..... B41M 5/02; D06L 3/12

[52] U.S. Cl. ..... 8/471; 8/470; 8/568; 8/570; 8/572; 8/574; 8/585; 8/586; 8/648; 8/917

[58] Field of Search ..... 8/471, 470

[56] References Cited

U.S. PATENT DOCUMENTS

| | | | |
|---|---|---|---|
| 2,895,785 | 7/1959 | Alsberg et al. | 8/449 |
| 2,950,165 | 8/1960 | Hadfield et al. | 8/549 |
| 4,167,392 | 9/1979 | Defago | 8/471 |
| 4,566,388 | 12/1985 | Rohrer | 8/549 |
| 4,568,350 | 2/1986 | Rohrer | 8/543 |

FOREIGN PATENT DOCUMENTS

| | | |
|---|---|---|
| 2456637 | 6/1975 | Fed. Rep. of Germany . |
| 52-066785 | 6/1977 | Japan . |
| 53-078386 | 7/1978 | Japan . |
| 1529199 | 10/1978 | United Kingdom . |
| 2112422 | 7/1983 | United Kingdom . |

*Primary Examiner*—A. Lionel Clingman

*Attorney, Agent, or Firm*—Ostrolenk, Faber, Gerb & Soffen

[57] ABSTRACT

When silk fabrics, pre-treated with swelling agents, are printed by heat transfer techniques, the fabric will yellow. The invention eliminates yellowing by pre-treating said silk fabrics with a liquid or solid impregnating agent, dissolved or dispersed in water, then drying the fabric, and adding before, during or after the pre-treating an optical brightening agent of the type normally used for polyester.

The impregnating agent can alternatively be applied to the fabric in a water-free condition before or during dyestuff transfer, and an optical brightener may be added.

It is further contemplated to use easily migrating dyestuffs which are transferred to the fabric at relatively very low temperatures, and to avoid dyestuff migration by pre-treating the silk fabric with solid impregnating agents.

All these techniques produce deep and brilliant shades; the prints have excellent fastnesses.

6 Claims, No Drawings

HEAT TRANSFER PRINTING OF NATURAL SILK SUBSTRATES

The present invention refers to methods for printing of textile materials fully or partially consisting of natural silk fibers, according to the principles of the so-called transfer printing, from a transfer sheet at an elevated temperature. These principles are for example described in French patents Nos. 1 223 330 and 1 585 119.

This invention is further related to an impregnating composition and to a transfer sheet for transfer printing.

It is well known that natural silk has substantially no affinity for dispersion dyestuffs which are commonly used in transfer printing, so that it is not possible to produce prints having acceptable fastnesses. However, since textile materials and articles of natural silk or containing mixtures of such fibers, are essential fashion products, transfer printing would bring about outstanding advantages such as flexibility in design storage, the possibility of an economic production of a valuable design even in relatively small quantities, the simplicity of the method, the absence of wash water contamination, the possibility of half-tone dyeing, etc. Furthermore, silk fabrics are often very light, having weights of as low as 20 g/m$^2$, which could be printed easily by transfer but only very difficulty, if at all, dyed by conventional liquor dyeing techniques.

It has already been tried to overcome the lack of affinity mentioned above, in order to get the silk dyeable by transfer printing. A first approach was the chemical modification of the silk fiber by grafting reactions or by acylation, but these methods are complex and expensive and do alter the hand and other physical properties of the silk materials. These methods could therefore not succeed.

Another possibility of rendering silk materials temporarily more affine to dispersion dyestuffs was for example disclosed in Japanese patent application No. 53-78386, French Pat. No. 2 296 537, and U.K. Pat. No. 2 112 422 (which appears to be a selection from FR-A No. 2 296 537). The method comprises treating a textile material of natural silk with an aqueous composition, containing certain swelling agents, and then drying the treated textile material. It is believed that the effect of this pre-treatment consists in swelling the silk fiber and to maintain the swollen state of the fiber even after drying, i.e. in its water free condition. Afterwards, a heat transfer printing step is accomplished, and the remaining swelling agent seems to act as a solvent phase for the dispersion dyes during the transfer step. Acceptable fastnesses are generally obtained after a final washing or rinsing of the silk material whereby the swelling agent is eliminated.

It has further been found that the transfer printing of silk which has been pre-treated as depicted above, namely which contains a swelling or impregnating agent, for example a polyhydric alcohol, suffers from the disadvantage that the silk strongly yellows in the heating step during the transfer printing, at the temperatures normally used in transfer printing. Attempts to avoid yellowing by reducing the transfer temperatures to 190° to 200° C. have not been successful since the brilliant shades required in silk printing, are no more attained with the dyestuffs used for the transfer printing of polyester, and furthermore, yellowing is only reduced but not eliminated.

Dispersion dyestuffs have become known from U.K. Pat. No. 2 112 422 which can be transferred at relatively low temperatures, e.g. at 170° to 180° C., in about 30 to 40 seconds from the transfer sheet to silk fabrics, e.g. C.I. Solvent Blue 36. However, these dyestuffs are so mobile even at room temperature that they migrate and recrystallize in the swelling agent used for the silk pre-treatment, namely polyhydric alcohols or their derivatives to such an extent that already after a dwell time of a few hours—such a time lag must normally be accepted before rinsing and cannot be shortened—, there are perceptible level differences in the originally produced print design.

The main object of the present invention is to provide a new and useful method for the transfer printing of pure and mixed silk textile materials which does not suffer from the above discussed disadvantages and drawbacks.

Another object of this invention is to provide such a method which, however, allows one to maintain the outstanding advantages of the transfer printing principles.

Still another object of the invention is to provide such a transfer printing process which can be carried out in the apparatuses, devices and machines already available or already installed at a given place such as a factory, thus minimizing capital investment, and which is economically feasible already with short lengths of silk textile materials to be printed.

A further object of the present invention is to develop a transfer printing process avoiding the yellowing of the silk substrate during the transfer heating.

These and still other objects are attained by the method of this invention which, in a first and principal embodiment, comprises the pre-treatment of the silk textile with an impregnating composition containing an optical brightening agent, designed for polyester, besides the impregnating agent. It has been found that such pre-treated silk fabrics dyed afterwards by transfer printing, do not show a yellowing and are fully equivalent, as to the shade of the uncolored basic material, to fabrics dyed by other processes.

Principally, one could imagine that compensation for the yellowing of silk fabrics during the transfer might be by a treatment with an optical brightener prior to the pre-treatment with the impregnating agent. However, such an optical brightening procedure is a real dyeing operation to be carried out according to the exhaustion dyeing method which lasts 30 to 45 minutes at a temperature of about 60° to 80° C. and requires special installations. Furthermore, another drying step would be necessary. Thirdly, such an optical brightening step cannot be carried out in an economically reasonable manner since generally only short lengths of silk are to be dyed or printed for any manufacturer's order. Finally, it has been found that the normally available optical brighteners, derived from stilbene, are not suited in that there is a yellowing of the silk substrate even on optically brightened silk textiles.

Therefore, it was very surprising that optical brightening agents for polyester, thus not for silk, effctively counteract yellowing during the transfer printing step when applied to the silk together with the impregnating agent in the pre-treatment step.

French patent specification no. 2 296 537, already mentioned above, speaks of transfer printing with sublimable dyestuffs or sublimable optical brighteners. The latter are only cited for sake of completeness since in some countries, optical brighteners (which generally have no substantial own color) are not considered as dyestuffs. Furthermore, the transfer of optical brighteners together with dyestuffs would not compensate for yellowing. And finally, sublimable optical brightening agents have insufficient fastnesses; the present invention therefore prefers the use of non-sublimable optical brighteners in the described pre-treatment which are better fixed in the silk textile substrate.

It is not known why an optical brightening agent, when separately applied to the silk textile material, for example in a separate dyeing step, does not prevent yellowing whereas an optical brightener applied together with the impregnating agent effectively does. This may perhaps be explained by the fact that the impregnating agent may act as a carrier for the brightening agent for introducing it into the fibers of the silk. Optical brighteners applied in a separate dyeing step remain of course mainly on the fiber surfaces.

Optical brighteners for polyester which may be used in the method of this invention are typically such which are non-ionogenic heterocyclic compounds, particularly oxazole, benzoxazole and triazine derivatives. Industrially manufactured products which may be used in this invention, and which belong to the classes cited above, are for example the following:

Fluolite XMF: (ICI)
Uvitex ERN: (Ciba-Geigy)
Uvitex ET: (Ciba-Geigy)
Uvitex EBF: (Ciba-Geigy)
Hostalux EBS: (Hoechst)
Hostalux EBU: (Hoechst)
Hostalux ERU: (Hoechst)
Ultraphor SFG: (BASF).

The amount of the optical brightener in the aqueous pre-treatment bath should be selected such that the amount thereof remaining after the application on the textile substrate would just be sufficient to prevent a yellowed appearance; higher amounts are not of advantage. The necessary amount can be determined by a few tests. It normally is in the range of 0.2 to 5% by weight of the dry silk fabric to be pre-treated. Should the pre-treatment liquor be applied to the silk fabric in such amounts that a pickup of about 100% results, the pre-treatment liquor will preferably contain 0.2 to 5% by weight of the brightening agent.

The pre-treatment can be carried out according to the techniques described in the above mentioned publications. Typically, the impregnation is made by padding on the pad mangle. The pre-treatment liquor should contain such an amount of impregnating agents that there will remain 50 to 30% by weight, preferably about 20% by weight thereof, in the silk fabric after drying.

Impregnating agents which can be applied prior to the transfer printing step from an aqueous phase, i.e. in solution, suspension or dispersion, as a pre-treatment agent, are in principle already known per se. These are typically polyhydric alcohols which may be monomers or polymers, which are colourless, do not attack silk and which have a solvatation power on the used dispersion dyestuffs at higher temperatures but do not dissolve them to a substantial extent at normal temperatures. Thus, should normally liquid impregnating agents be used, the dyestuffs which have been dissolved at higher temperatures should precipitate at normal temperature. Impregnating agents of the above defined classes may also be used which are liquid in the temperature range of 60° to 160° C.

The following impregnating agents have proven to be particularly appropriate in the method of this invention: polyethylene glycols having an average molecular weight of from 200 to 1000, particularly from 300 to 600; polypropylene glycols having an average molecular weight of from 400 to 1100, particularly from 400 to 900; polyethylene polypropylene glycols; 1,1,1-tris-(hydroxymethyl)-propane; 1,1,1-tris-(hydroxymethyl)-ethane; ε-caprolactam; nicotinamide; isonicotinamide; isopropylene urea; ethylene urea and glyoxal monourein.

Dyestuffs which may be used are those which can be applied by transfer on polyester substrates, generally dispersion dyestuffs, for example C.I. Disperse Red 60, C.I. Disperse Yellow 54, C.I. Disperse Blue 331, C.I. Disperse Blue 72, C.I. Disperse Blue 19, C.I. Disperse Violet 1. The more water insoluble the dyestuffs are, the better are generally the final washing fastnesses.

The use of a trichromies which contain as a blue dyestuff 1,4-diisopropylamino anthraquinone, as a red dyestuff 1-amino-2-chloro-4-hydroxyanthraquinone (also 1-amino-2-bromo-4-hydroxyanthraquinone can be used), and as a yellow dyestuff the product having the formula

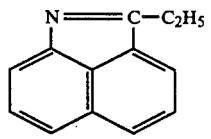

are novel and should specially be emphasized.

However, they are the migrating dyestuffs, and in order to keep down the migration, the cited trichromies should only be used together with silk substrates having been pre-treated with one of the above described impregnating agents which are solids up to at least 60° C.

The transfer printing step may be carried out in practice as usual; details may be taken from the publications of the prior art mentioned and discussed above. However, it has been found that for special substrates and special effects, specially adapted process conditions should be provided. The brilliant shades necessary for natural silk having acceptable general fastnesses of the print can be realized at 205° C. at 30 seconds. The penetration of the printing pattern which is required for many silk products like shawls etc., where both sides should not differ from each other, is outstanding for light-weight silk fabrics having a weight up to 50 g/m$^2$. Heavier fabrics can be transfer printed with such a pattern if the pressure of the transfer sheet to the textile material is increased, i.e. to about $10^3$ until $10^6$ Pa, preferably to $5\times10^3$ Pa and more.

Another possibility to print heavier silk fabrics having a weight of more than 50 g/m$^3$, with a perfect penetration is the use of dyestuffs capable of being transferred at a temperature of at least 190° C. in 40 seconds with substantially 100% yield from the transfer sheet to the pre-treated silk. In order to solve the well known problem of the worsening of the print pattern by migration, experiments were made, and it has been found that certain impregnating agents do not form migrating systems with this rapidly subliming dyestuffs, e.g. C.I. Solvent Blue 36. This fact is believed to be based on the incompatibility of dyestuff and impregnating agent, required according to this invention for temperatures below about 60° C. as it has already been indicated.

Such impregnating agents are those already listed above, liquid polyglycols excepted. The transfer prints thus obtained are resistant to an impairing of the print pattern until eight weeks when kept at a temperature below 40° C. At this time at the latest, the rinsing or washing should be effected. It will be sufficient to rinse the fabric some times in lukewarm water of 40° C.

The dyestuffs to be used are typically sparingly water soluble. When the pre-treatment of the silk fabric has been made with liquid glycols, cold rinsing is sufficient. When waxy glycols are used, warm water is preferred. When surfactants are added in order to improve the wetting of the textile materials, such agents must be applied which do not render the dyestuffs more soluble. After the rinsing step, the textile materials is dried.

It has surprisingly been found that the impregnating agents—which hinder migration—can also be applied to natural silk in a melting transfer method without impairing the result of the sensibilisation of the silk for subliming dyestuffs.

This further embodiment of the process of this invention is particularly suited for those transfer printers who do not have the possibility of carrying out a pre-treatment of the fabric with an aqueous liquor.

In this "dry" pre-treatment method, the classes of organic substances of polyethylene glycols, polypropylene glycols, mixed polyethylene polypropylene glycols; 1,1,1-tris-(hydroxymethyl)-propane; 1,1,1-tris-(hydroxymethyl)-ethane, ε-caprolactam, nicotinic acid amide, isonicotinic acid amide, isopropylene urea, ethylene urea, glyoxal monourein, and their mixtures are effective, which are solid at temperatures below 60° C. and liquid in the range between 60° and 200° C. Furthermore, they contain nitrogen and are substantially colorless.

As an impregnating agent, the following substances have proven as particularly useful: isonicotinamide, ε-caprolactam, nicotinamide, propylene urea, ethylene urea, glyoxal mono-urein, urea, 5,5-dimethyl hydantoin, imidazole, 2-methyl imidazole, N-methyl pyrrolidone, N-hydroxy succinic amide, and mixtures from these substances.

Since all these substances listed above are well soluble in water, aliphatic or aromatic hydrocarbons are preferred as solvents for the printing ink which are water insoluble, or other water insoluble solvents. As a binder, film forming substances must be used which are soluble in water and in these other solvents as well, because impregnating agent and binder must be capable of being eliminated by water rinsing from the silk substrate following the transfer printing.

Furthermore, the film forming binder must either have a melting print (or melting range) between 60° and 200° C., or it must be soluble in the molten impregnating agent. Hydroxypropyl cellulose brands are a particularly well suited film forming binder having the above listed necessary properties. Since the melt which forms during the transfer printing step from impregnating agent and binder, should be as non-viscous as possible, it is preferred to combine the binder with a plasticizer.

The transfer printing of the silk may be carried out, in this embodiment of the invention, in two different manners:

(1) An unprinted base paper for gravure printing is coated with a pre-treatment composition comprising a solvent, a binder and an impregnating agent, in such a manner that a layer containing from 5 to 25 g of impregnating agent per $m^2$ of base paper is formed.

This layer is then transferred to the silk substrate by means of a conventional transfer calender or a transfer press at a temperature of about 100° to about 200° C. Then, a coloured pattern on a transfer paper is transfer printed in the usual way (e.g. 200° C., about 30 sec) onto the thus pre-treated substrate.

Following this transfer printing, the impregnating agent and the binder are removed from the printed product by rinsing it with water.

(2) A transfer printing paper is coated with a treatment and printing composition composed of an aliphatic or aromatic hydrocarbon as a solvent, the special binder, said impregnating agent and at least one of the dyestuffs listed and discussed above, in such a manner that the layer which is formed will contain, after drying, from about 5 to about 25 $g/m^2$ of impregnating agent.

After drying, this paper is placed on untreated silk in a conventional transfer printing calender or in a transfer press. "Untreated silk" means silk which has not specially been pre-treated in view of rendering it more receptive for dyestuffs. Other treatments are of course possible and often necessary.

After rinsing with water, a product is obtained showing a billiant printing and the characteristic hand of silk.

In both cases discussed above, the coating composition should be added from 0.2 to 5% of an optical brightener which is well soluble in aromatic or aliphatic solvents but substantially insoluble in water, in order to compensate for a possible yellowing of the silk. Such optical brighteners are proposed for the spin melt dyeing and the cake dyeing of polyester fibers and are mostly benzoxazole derivatives. Representative members thereof are the products called "UVITEX OB" (Ciba-Geigy), "KODEL" (Eastman-Kodak) and "SANDUVOR VSU" (Sandoz).

A pre-treatment of the silk in the transfer calender is specially recommended for transfer papers which have been obtained by screen printing whereas transfer papers printed by offset or gravure printing are preferably overcoated as described above.

It should further be added that there is a fundamental difference between the instant method and that known from French Pat. No. 2 277 680 in the transfer printing of hydrophilic fiber materials. That French patent, page 9, line 31, imperatively calls for the binder to completely remain on the base paper after the transfer printing step. It is supposed that the sensibilisation of the hydrophilic fibers should obviously, in the French patent process, be accomplished by the sublimation of the impregnating agent whereas, in the instant method, impregnating agent and binder are transferred together via their melt on the silk. For this reason, only binders with special, outstanding properties can be used in the present method whereas the French patent expressly mentions that all binders known from the lacquer and printing ink industry may be used.

Another possibility to obtain strong and deep prints and a high penetration is to use transfer papers printed with relatively very high dyestuff amounts. This feature has not been obvious since deep shades normally impair the rubbing fastnesses (see e.g. BASF Publication CTE-072 d, page 10). It has surprisingly been found that this was not the case. On the contrary, it has been found that dyestuffs known for the transfer printing on polyester, namely C.I. Disperse Red 60, C.I. Disperse Yellow 54 and C.I. Disperse Blue 331, provide when printed on silk by transfer, the standard type depth of 2/1 with the same textile fastnesses as if transfer sheets would be used containing as much dyestuffs as 1 to 2.5 g/m², preferably 1.5 g/m². When these transfer sheets are prepared by gravure printing using a normal gravure, this value can be obtained with a printing ink containing about 15% by weight of dyestuffs. It should be noted that the normal transfer printing of polyester uses typically dyestuff amounts not exceeding 0.75 g/m².

The amounts of dyestuff mentioned above are referred to the the square meter of printed area, i.e. those surface regions are not taken into acount which are free from dyestuffs. It is now especially surprising that the improvement of shade depth is also obtained even on extremely light-weight silk qualities having a weight of less then 50 g/m², where already the conventional dyestuff concentrations of about 0.75 g/m² will result in a shade depth which is identical on both sides of the fabric.

The man skilled in the art could not expect that an available dyestuff amount being about twice the normal amount would lead to this surprising results since already the normal amount of dyestuff will leave a dyestuff residue on the transfer sheet after the transfer printing. See the following example 4.

The exact choice of the method parameters, specially the dyestuff available on the transfer sheet, will depend upon the weight and the construction of the silk fabric and the effects sought. Generally, the results are outstanding if the dyestuff available will be 50 to 100% higher than for the conventional transfer printing on polyester.

Still more brillant shades and generally good fastnesses are obtained with the following dyestuffs: C.I. Solvent Yellow 160, C.I. Disperse Red 55, C.I. Disperse Blue 56 and C.I. Disperse Blue 60.

It should be expected that these dyestuffs could not be used for the transfer printing of silk since they are only slowly subliming and must be transferred on polyester at 210° C. as long as 60 seconds—see, i.e., for C.I. Disperse Blue 60: "Transfer printing of Polyester", Technical Headlines BR 1107, Yorkshire Chemicals Limited, Leeds, U.K.). Under these transfer conditions, a strong yellowing of the silk is observed even when swelling agents are absent, and the penetration of the textile material by the dyestuff is not sufficient.

It has surprisingly be found that, when these dyestuffs are mixed with other dyestuffs commercially used for the transfer printing of polyester, namely C.I. Disperse Yellow 54, C.I. Disperse Red 60 and C.I. Disperse Blue 331, a dyestuff system is obtained which gives under transfer conditions of 200° to 205° C. at 40 seconds prints having an excellent penetration, good brilliance and outstanding fastnesses.

It has been especially surprising that the dyestuff C.I. Solvent Yellow 160, which gives on natural silk prints of high brilliance but of a very bad light fastness (note 2), provides prints with good brilliance and a good light fastness (note 4.5), when the printing ink for making the transfer sheet contains about 30 to 70% of this dyestuff, preferably about 50%, together with 70 to 30%, preferably about 50%, of the dyestuff C.I. Disperse Yellow 54.

The transfer sheets which are typically made of paper, can be obtained in the well known conventional manner. This feature of the present method is a described per se in the already mentioned literature.

The method of this invention has the additional advantage that the great variety of pattern and design collections already existing at the transfer printer can be used without any additional work or modifications.

The following examples are given to illustrate and explain in further details this invention and are not construed to limit it in any way. If not otherwise indicated, all percentages and parts refer to the weight. All numeric amounts and ranges, temperatures included, are to be understood as approximate values.

Where gravure printing is mentioned, other printing methods may as well be used such as offset or screen printing.

EXAMPLE 1

A silk fabric, quality "chiffon", desized and bleached as usual, having a weight of 25 g/m², is padded with an aqueous liquor containing 200 g per liter of polyethylene glycol 300 and 20 g per liter of the optical brightening agent "UVITEX ET" (Ciba-Geigy), to a pickup of 100% and is then dried on the tenter frame during one minute at 120° C.

The silk fabric thus pre-treated is covered with a transfer paper having a weight of 40 g/m² which has been printed by gravure printing with a printing ink containing the dyestuffs C.I. Disperse Red 60, C.I. Disperse Yellow 54 and C.I. Disperse Blue 331.

The transfer is made at 30 seconds at 205° C. A brilliant print having a good fastnesses and a good resolution is obtained which could not be realized on an material having such a low weight with conventional printing methods. The penetration of the fabric by the dyestuffs is so deep that the upper and the reverse sides show substantially the same intensity.

Within two months after the transfer printing, the polyethylene glycol is rinsed from the fabric by treatment with water, and the fabric is dried on a tenter frame.

EXAMPLE 2

A silk fabric having a weight of 70 g/m², desized and bleached as usual, is padded to 100% pickup with an aqueous liquor containing 20% of ε-caprolactam, and then dried for two minutes at 100° C. The fabric is covered with a transfer paper having a weight of 60 g/m² which has been printed by gravure printing with inks containing as a blue dyestuff 1,4-diisopropylamino anthraquinone, as a red dyestuff 1-amino-2-chloro-4-hydroxyanthraquinone (also 1-amino-2-bromo-4-hydroxyanthraquinone may be used), and as a yellow dyestuff a compound of formula

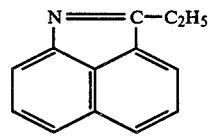

The transfer printing is effected in about 30 seconds at 170° C.

A brilliant print with good fastnesses and excellent penetration of dyestuffs is obtained. There is no yellowing of any remaining white basic bottom shade on uncolored area regions.

Within two months after the transfer printing, the impregnating agent is rinsed from the fabric with water of 40° C. and the fabric is dried on a tenter frame.

EXAMPLE 3

A silk fabric, desized and bleached as usual, having a weight of 100 g/m$^2$ is padded with an aqueous liquor containing 20% of ε-caprolactam at a pickup of 100% and dried on a tenter frame during 2 minutes at 120° C.

This fabric is covered by a transfer paper having a weight of 40 g/m$^2$, which has been printed by gravure printing with printing inks characterized firstly by a total concentration of dyestuff corresponding to the amount for the conventional transfer printing for polyester, and secondly having as basic dyestuffs a mixture of the dyestuffs of Example 1 with those of Example 2. For example, a printing ink has been used for a highly brilliant red shade which contains 90% of the C.I. Disperse Red 60 and 10% of 1-amino-2-chloro-4-hydroxyanthraquinone.

The transfer printing is effected during 40 seconds at 200° C. A highly brilliant print having good fastnesses and excellent penetration of dyestuffs is obtained.

Within two months from the transfer printing, the impregnating agent is eliminated from the fabric by rinsing with water of 40° C. Finally, the fabric is dried on a tenter frame.

EXAMPLE 4

A. A silk fabric, desized and bleached, having a weight of 25 g/m$^2$, is pre-treated according to the method of Example 1.

The pre-treated and dried silk fabric is transfer printed during 40 seconds at 205° C. with a transfer paper, containing in a homogeneous dissolution 0.75 g of the dyestuff C.I. Disperse Red 60.

B. The dyestuff which remained on the paper after the transfer was dissolved in dimethyl formamide, and its amount was determined by spectrometry. 24% of the original dyestuff amount had remained on the paper.

C. In a second test, a transfer paper was used in transfer printing containing 1.5 g/m$^2$ of the same dyestuff and under the same conditions. After transfer, it was determined by colormetry that the shade depth on the silk fabric was 1.8 times higher than in the first test, that a standard type depth of 2/1 had been obtained on both sides of the fabric, and that 25.4% of the dyestuff was left on the transfer sheet after transfer.

EXAMPLE 5

A silk fabric of 70 g/m$^2$, desized and bleached as usual, is padded to 100% pickup with an aqueous liquor containing 20% of polyethylene glycol 300 and 2% of Uvitex EBF (Ciba-Geigy), and then dried during two minutes at 100° C. The fabric is covered with a transfer paper having a weight of 40 g/m$^2$ which had been printed by gravure printing with inks containing as a red dyestuff 10% of C.I. Disperse Red 60 and 10% of C.I. Disperse Red 55, as a yellow dyestuff 10% of C.I. Disperse Yellow 54 and 10% of C.I. Solvent Yellow 160, and as a blue dyestuff 10% of C.I. Disperse Blue 331 and 10% of C.I. Disperse Blue 60.

The transfer printing is made in 40 seconds at 205° C.

A very brilliant printing having excellent fastnesses and good penetration of the dyestuffs into the silk fabric is obtained.

EXAMPLE 6

A coating composition is prepared in a ball mill in which 39 parts of nicotinic acid amide and 6 parts of hydroxypropyl cellulose of the type "Klucel E", of Hercules Inc., dissolved in a mixture of 33 parts of toluene and 22 parts of ethanol, wherein 0.5 part of UVITEX OB has been previously dissolved, are charged. When all ingredients are well distributed, the so obtained coating mass is used to coat a base paper for transfer printing, having a unit weight of 60 g/m$^2$, in an amount giving after drying a quantity of nicotinic acid amide of 15 g/m$^2$.

This layer is now transferred in a conventional transfer printing calender on a silk fabric at 140° C. and during a contact time of about 20 seconds.

On the so pre-treated textile material, a transfer printing paper is printed at 200° C. during a contact time of 30 seconds. After the transfer printing, the silk is rinsed with lukewarm water and finally dried. A brilliant print having the typical silk hand is obtained.

EXAMPLE 7

A transfer paper obtained by gravure printing, is coated with the coating composition of Example 6 in such amounts that the dried coating layer represents 10 g/m$^2$ of nicotinic acid amide.

The paper so obtained is transfer printed, on a conventional transfer calender, at about 205° C. and during 25 seconds on a silk fabric not specially pre-treated. The printed material is rinsed with hand-warm water. After drying, a printed silk fabric with brilliant shades and the correct hand is obtained.

The man skilled in the art will be aware that there are numerous variations and modification which may be put forward to the process and the other subjects of this invention, which may thus only be limited by the scope of the appending claims.

We claim:

1. A method for the printing of textile materials at least partially consisting of natural silk fibers, by the heat transfer printing process at a temperature selected in the range of from about 170° to about 230° C.in the absence of a vacuum or a carrier gas or both, using a transfer sheet carrying at least one dyestuff to be heat transferred to said textile material, wherein said method comprises impregnating said textile material, prior to said heat transfer printing, with a dry impregnating composition containing an impregnating agent capable of improving the affinity of the said silk fiber to dyestuffs, said impregnating agent being selected from colorless, nitrogen containing, organic substances which are solid below 60° C. and liquid in the temperature range of from about 60° to about 200° C., and which exert in their liquid state but not in their solid state a solvatation power on the dyestuffs used wherein said impregnating agent is selected from ε-caprolactam, nicotinamide, isonicotinamide, propylene urea, ethylene urea, glyoxal mono-urein, urea, 5,5-dimethyl hydantoin, imidazole, 2-methyl imidazole, N-methyl pyrrolidone, N-hydroxy succinic amide, and mixtures thereof.

2. The method of claim 1 wherein said impregnating composition further contains at least one optical brightening agent soluble in aromatic and/or aliphatic organic solvents but at most sparingly soluble in water.

3. The method of claim 1 wherein said impregnating composition further contains a water soluble, film-forming binder, said composition being present as a layer on a transfer sheet, and is applied to the said textile material by the heat transfer process prior to said heat transfer printing.

4. A method for the printing of textile materials at least partially consisting of natural silk fibers, by the heat transfer process at a temperature selected in the range of from about 170° to about 230° C. in the absence of a vacuum or a carrier gas or both, using a transfer sheet carrying at least one dyestuff to be heat transferred to said textile material, wherein said method comprises using a transfer sheet carrying said dyestuff, dry impregnating agent capable of improving the affinity of the said silk fibers to dyestuffs, said impregnating agent being selected from colorless, nitrogen containing, organic substances which are solid below 60° C. and liquid in the temperature range of from about 60° to about 200° C., and which exert in their liquid state but not in their solid state a solvatation power on the dyestuffs used, and a water soluble, film-forming binder, these said components being present at a layer on said transfer sheet wherein said impregnating agent is selected from ϵ-caprolactam, nicotinamide, isonicotinamide, propylene urea, ethylene urea, glyoxal mono-urea, 5,5-dimethyl hydantoin, imidazole, 2-methyl imidazole, N-methyl pyrrolidone, N-hydroxy succinic amide, and mixtures thereof.

5. The method of claim 4, wherein said layer further contains at least one optical brightening agent soluble in aromatic and/or aliphatic organic solvents but at most sparingly soluble in water.

6. A method of transfer printing of textile materials partially or fully consisting of natural silk fibers from a transfer sheet containing at least one dyestuff comprising treating said textile material prior to or simultaneously with the transfer printing step with a transfer sheet containing a dry, anhydrous, solid at room temperature composition containing at least one impregnating agent capable of improving the affinity of said silk fibers to dyestuffs, said impregnating agent being selected from colorless, nitrogen containing, organic substances which are solid below 60° C. and liquid in the temperature range from about 60° to about 200° C., and which exert in their liquid state but not in their solid state a solvatation power on the dyestuffs used, in an amount from 5 to 25 g of impregnating agent per square meter of transfer sheet, and effecting said dyestuff's transfer at a temperature from about 170° to about 230° C. in the absence of a vacuum or a carrier gas or both wherein said impregnating agent is selected from ϵ-caprolactam, nicotinamide, isonicotinamide, propylene urea, ethylene urea, glyoxal mono-urein, urea, 5,5-dimethyl hydantoin, imidazole, 2-methyl imidazole, N-methyl pyrrolidone, N-hydroxy succinic amide, and mixtures thereof.

* * * * *